US007850448B2

(12) United States Patent
Slaby

(10) Patent No.: US 7,850,448 B2
(45) Date of Patent: Dec. 14, 2010

(54) FURNACE

(75) Inventor: Terrance C. Slaby, North Royalton, OH (US)

(73) Assignee: Beckett Gas, Inc., North Ridgeville, OH (US)

( * ) Notice: Subject to any disclaimer, the term of this patent is extended or adjusted under 35 U.S.C. 154(b) by 1077 days.

(21) Appl. No.: 10/591,110

(22) PCT Filed: Mar. 3, 2004

(86) PCT No.: PCT/US2004/006482

§ 371 (c)(1),
(2), (4) Date: Aug. 31, 2006

(87) PCT Pub. No.: WO2005/095870

PCT Pub. Date: Oct. 13, 2005

(65) Prior Publication Data

US 2007/0272228 A1 Nov. 29, 2007

(51) Int. Cl.
*F23Q 9/08* (2006.01)

(52) U.S. Cl. ..... 431/281; 431/285; 126/104 A; 126/111; 126/116 R; 126/99 D; 432/17

(58) Field of Classification Search ..... 431/281, 431/285; 126/104 A, 111, 116 R, 116 A, 126/110 A, 99 D; 432/17
See application file for complete search history.

(56) References Cited

U.S. PATENT DOCUMENTS

| | | | | |
|---|---|---|---|---|
| 5,059,117 | A | 10/1991 | Wills | |
| 5,406,933 | A | 4/1995 | Lu | |
| 6,109,255 | A | 8/2000 | Dieckmann et al. | |
| 6,450,162 | B1 | 9/2002 | Wang et al. | |
| 6,474,328 | B1 | 11/2002 | Fells | |
| 6,495,092 | B1 * | 12/2002 | Hazama et al. | 266/156 |

* cited by examiner

*Primary Examiner*—Alfred Basichas
(74) *Attorney, Agent, or Firm*—Tarolli, Sundheim, Covell & Tummino LLP

(57) ABSTRACT

A gas fired furnace capable of operating with a 16:1 turndown ratio or greater. The furnace includes a plurality of burners (10) grouped into at least (14*a*) first and second (14*b*) groups, each group connected to a source of combustible gas through a control valve (30*a*, 30*b*, 30*c*). The control valve (30*c*) controlling at least one group of burners is of a modulating type having an output proportional to a control signal applied to the valve. The burners fire into associated heat exchange tubes (20*a*), each tube having an inlet (24) and an outlet. The tube outlets are connected to a collector chamber (44) that includes a baffle plate (60) that divides the collector into two sections, one of the sections communicating with the outlets of the tubes associated with the first group of burners, the other section communicating with the outlets of the heat exchanger tubes associated with the other group of burners.

16 Claims, 5 Drawing Sheets

FURNACE

TECHNICAL FIELD

The present invention relates generally to heating apparatus and, in particular, to a gas fired furnace having multiple burners.

BACKGROUND ART

Furnaces utilizing gas fired, "inshot" type burners are in common use today. One application for this type of furnace includes the heating of air circulating through a duct. Duct heating furnaces generally include one or more heat exchange tubes that are positioned in the air duct and heat the air as it is circulated through the duct.

The inshot burners fire into inlets of the heat exchange tubes. The products of combustion are drawn through the tubes by an induced draft blower which is connected to a flue or other discharge conduit through which the products of combustion are discharged.

It is desirable that the furnace be capable of a variable output so that a relatively constant air temperature can be maintained in the duct. If the furnace is only capable of operating at one BTU level, large swings in air temperature can result due to the on/off cycling of the furnace.

In the past, attempts have been made to design furnaces of this type that are capable of variable outputs depending on the heating requirement as sensed by temperature sensors in the duct. It has been found that furnaces and burners of this type are generally limited to a maximum 2:1 turndown ratio, i.e., the furnace can operate at either 50% or full output. Generally, as the furnace output is reduced, CO emissions increase and flame instability may also result. Attempts have been made to provide duct-type furnaces capable of operating at less than 50% of maximum output, but these attempts have not been totally successful.

DISCLOSURE OF INVENTION

The present invention provides a new and improved duct-type furnace that utilizes multiple inshot burners. The furnace is capable of operating with at least an 8:1 turndown ratio. The disclosed furnace can vary its output from its maximum rated capacity to less than ⅛ of its maximum output. When multiple furnaces are installed in a single cabinet or duct structure, and controlled in tandem, turndown ratios substantially greater than 8:1 can be achieved.

In accordance with the invention, the furnace comprises a heating apparatus that includes a plurality of burners that are grouped into at least first and second groups. A source of combustible gas and a modulating gas control valve is connected to the first group of burners. The modulating control valve controls the flow of combustible gas from the source to the first group of burners in accordance with a temperature related control.

The second group of burners, in at least one embodiment, are connected to a source of combustible gas through a conventional gas control valve. The conventional gas control valve may be either of a single stage or dual stage variety. When a dual stage valve is utilized, the burners can be operated at one of two firing rates, i.e., a maximum firing rate and 50% of the maximum firing rate. When a dual stage control valve is utilized, a "sequencer" or a dual stage thermostat effects control over the dual stage valve.

A heat exchange tube which may include dimples is associated with each burner and includes an inlet into which the burner fires and an outlet connected to a collector chamber. In accordance with the invention, the collector chamber is divided into sections by a baffle member, one of the sections communicating with the outlets of heat exchange tubes associated with the first group of burners, another section of the collector chamber communicating with the outlets of the heat exchange tubes associated with the second group of burners. A multispeed induced draft blower includes an inlet which concurrently communicates with the collector chamber sections.

In accordance with a feature of the invention, the baffle member is offset within the collector chamber so that the size of the collector chamber sections compensates for differences in mass flow density of the gases flowing out of the heat exchange tubes during furnace operation. When only the first group of burners is being fired, ambient, secondary air is being drawn through the heat exchange tubes associated with the other group of burners. Ambient air has a mass flow density that is greater than flue gases that are flowing through the heat exchange tubes associated with the first group of burners. Offsetting of the baffle within the collector chamber compensates for the differences in mass flow density of the ambient air and flue gases being conveyed to respective collector chamber sections.

In accordance with another feature of the invention, a shoot-through plate including openings aligned with the burner and the associated heat exchange tube inlet is spaced from the tube inlet so as to provide a secondary air path that is radial or offset with respect to an axis of the burner. In the past, secondary air for combustion flowed along the burner body along a path that is generally parallel to the axis of the burner. With the disclosed invention, secondary air travels in a substantially orthogonal path with respect to the burner body and results in increased flame stability. In addition, the burners can be operated at a high port loading without substantially increasing CO emissions or causing flame instability.

In the preferred and illustrated embodiment, a secondary air blocking plate extends from the shoot-through plate to a bracket that supports a burner in its operative position. This blocking plate restricts the flow of secondary air along the body of the burner and also aids in flame stability and reduction in CO emissions.

According to the preferred embodiment, the furnace may be operated over a wide range of output by operating the first group of burners over a 4:1 turndown ratio while the other group of burners is: 1) not fired, 2) operated at a 2:1 turndown ratio or 3) operated at a maximum output. With this combination of operating steps, the disclosed furnace can operate with a 16:1 turndown ratio.

In accordance with still another feature of the invention, multiple furnace modules may be mounted in a single cabinet or duct structure to provide an effective turndown ratio for the overall heating apparatus that is substantially greater than 8:1. For example, two furnace modules may be mounted in the duct where one module is constructed in accordance with the preferred embodiment of the invention (and is capable of a 8:1 turndown ratio) whereas the other furnace module is of a standard configuration and can be operated at a 2:1 turndown ratio. With this combination of furnace modules, an effective turndown ratio of 32:1 can be achieved.

Additional features of the invention will become apparent and a fuller understanding obtained by reading the following description made in connection with the accompanying drawings.

BEST MODE FOR CARRYING OUT THE INVENTION

FIGS. 1-4 illustrate the overall construction of a heating module 11 constructed in accordance with a preferred embodiment of the invention. The illustrated module is intended to be mounted in a duct and heats air traveling through the duct.

Figure 3:
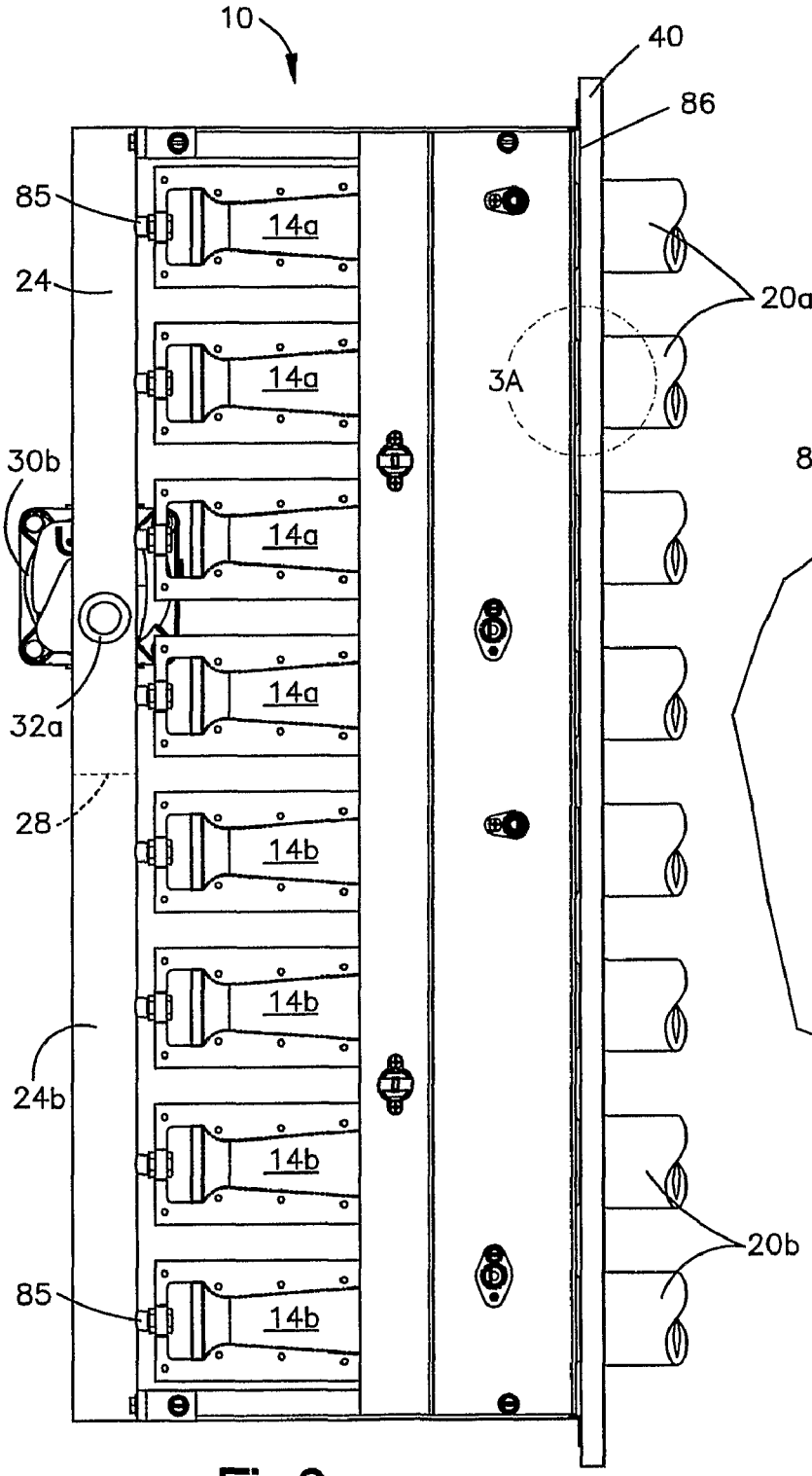
FIG. 3 is a plan view, partially in section, of the furnace shown in FIG. 1 as seen from the plane indicate by the line 3-3.
Figure 4:
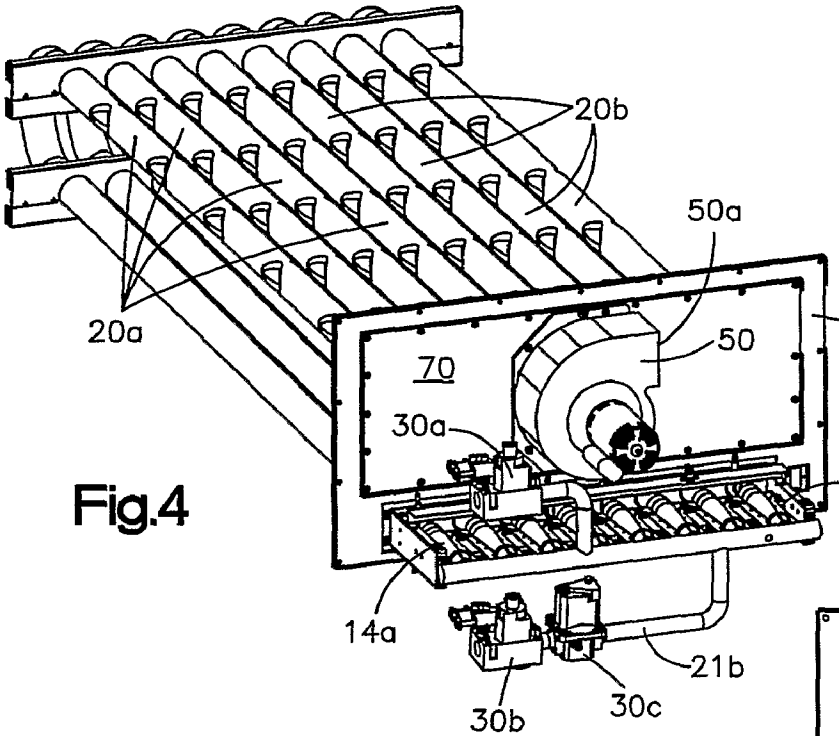
FIG. 4 is a perspective view of the furnace shown in FIG. 1.

The module includes a burner assembly 10, which as seen best in FIG. 3, comprises a plurality burner units 14*a*, 14*b*, which fire into and heat associated heat exchanger tubes 20*a*, 20*b* (see FIG. 4). In the illustrated embodiment, the heat exchanger tubes 20*a*, 20*b* are substantially identical in construction. When referring to a heat exchanger tube in general, it will be referred to by the reference character 20. The burners 14*a*, 14*b* are more fully disclosed in U.S. Pat. No. 5,186,620, entitled "Gas Burner Nozzle," which is also owned by the assignee of the present invention and which is hereby incorporated by reference.

The burners 14*a*, 14*b* are fed a combustible gas from a manifold assembly 24. In accordance with the invention, the manifold assembly 24 is divided into non-communicating manifold sections 24*a*, 24*b* by a separator plate 28. The manifold section 24*a* feeds the burners 14*a*, whereas, the manifold section 24*b* feeds the burners 14*b*. Each manifold section is connected to an associated gas valve. In particular, the manifold section 24*a* is connected to a gas valve 30*a* by a gas feed pipe 32*a*, whereas the manifold section 24*b* is connected to an associated gas valve 30*b* by a gas feed pipe 32*b*. As is conventional, the gas valves 30*a*, 30*b* are suitably connected to a source of combustible gas.

The gas valves 30*a*, 30*b* may be either conventional single stage or dual stage valves. As is known, a single stage valve, which is generally electrically operated, communicates the source of combustible gas with the burners when energized. A dual stage valve, which is also electrically operated, is generally controlled by a "sequencer" or two (2) stage thermostat. When energized, a dual stage valve provides combustible gas to the burners at one of two pressures, i.e., source pressure or 55% of source pressure (second stage) (first stage). The sequencer, or other control, determines the staged energization of the control valve.

In accordance with the invention, the gas feed pipe 32*b*, which feeds the burners 14*b*, also includes a modulating gas valve 30*c* disposed intermediate the control valve 30*b* and the burners 14*b*. The modulating valve can provide a range of gas pressures proportional to a control signal generated by a furnace control. It should be noted here that the gas control valve 30*b* and modulating valve 30*c* can be combined into a single valve assembly.

Figure 1:
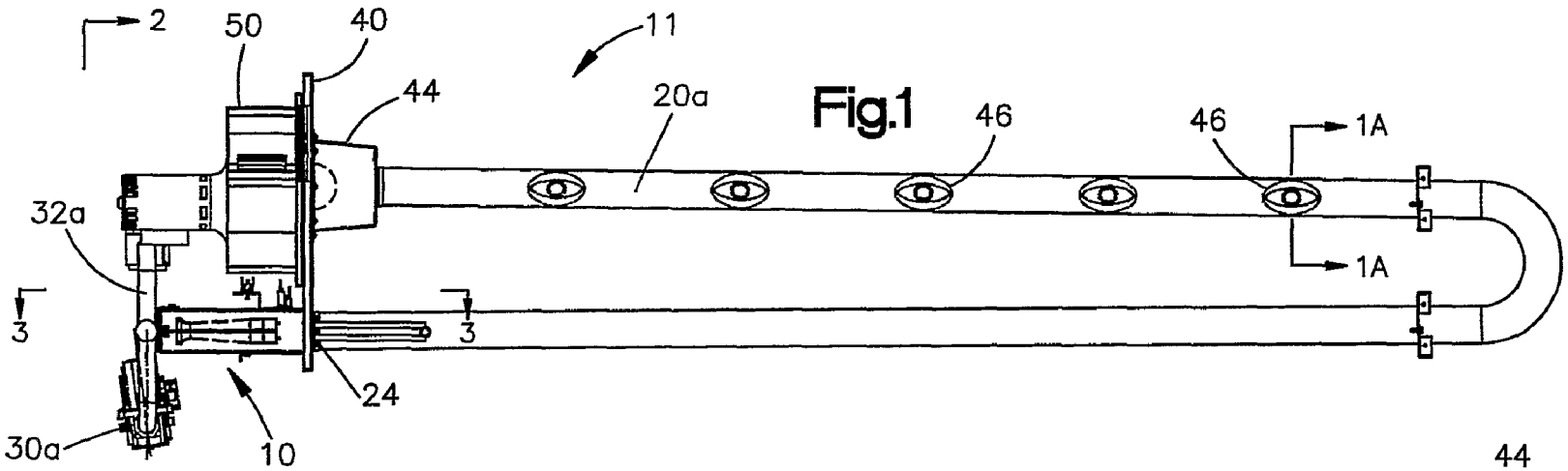
FIG. 1 is a side elevational view of a duct-type furnace constructed in accordance with a preferred embodiment of the invention.
Figure 2:
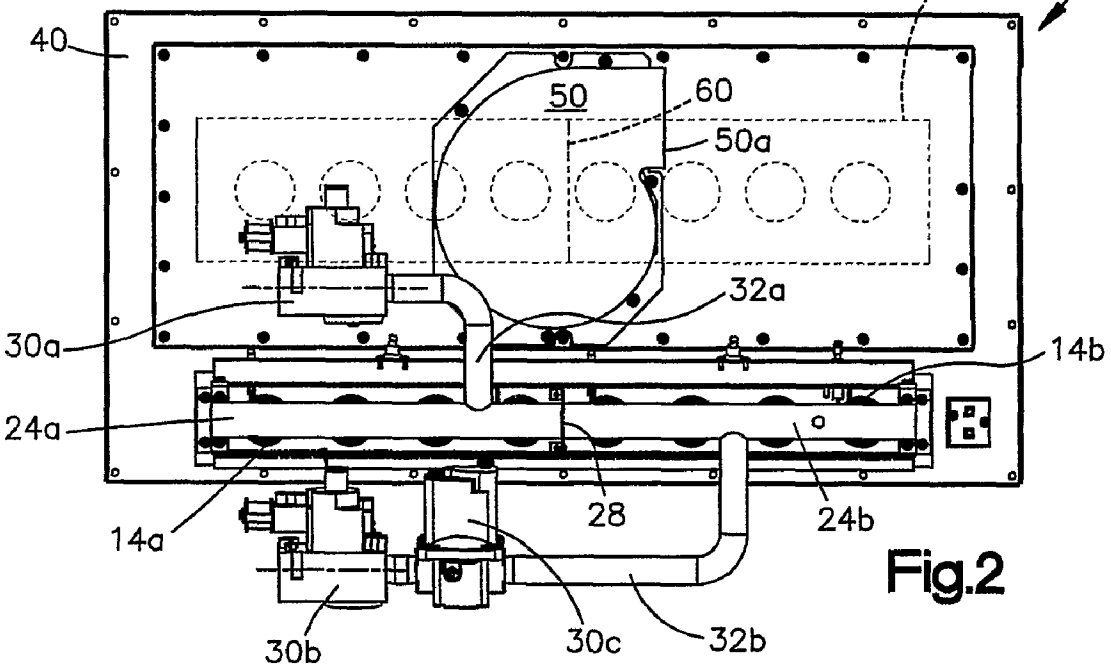
FIG. 2 is an end view of the furnace shown in FIG. 1.
Figure 1A:
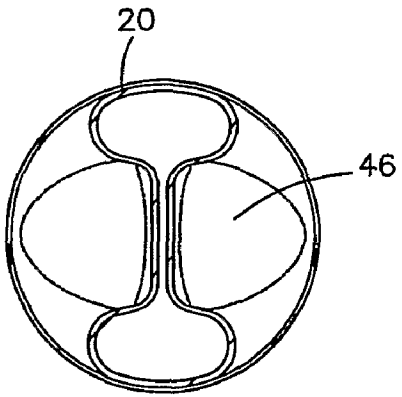
FIG. 1A is a sectional view as seen from the plane indicated by line 1A-1A in FIG. 1.

As seen best in FIG. 1, each heat exchanger tube is substantially U-shaped in construction. It should be noted that the heat exchanger tubes can take on various shapes including serpentine shapes and should not be limited to the U-shape shown in FIG. 1. The burners 14*a*, 14*b* fire into an inlet end 24 of an associated heat exchange tube. The inlet ends 24 of the heat exchange tubes 20*a*, 20*b* are connected to a vestibule plate 40. Each heat exchange tube terminates at a common collector box 44. The collector box is in turn also connected to the vestibule plate 40.

In the illustrated embodiment, each heat exchanger tube includes a plurality of dimples 46 which increase the heat exchange efficiency of the tubes. The construction and purpose of the dimples are fully explained in U.S. Pat. No. 6,688,378, which is also owned by the assignee of the present invention and is hereby incorporated by reference. As is conventional, the resulting combustion products generated by a given burner are conveyed through an associated heat exchange tube from the tube inlet 24 to the collector box 44. The combustion products or flue gas are drawn into the collector box 44 by an induced draft blower 50 capable of operating at two different speeds.

Figure 5:
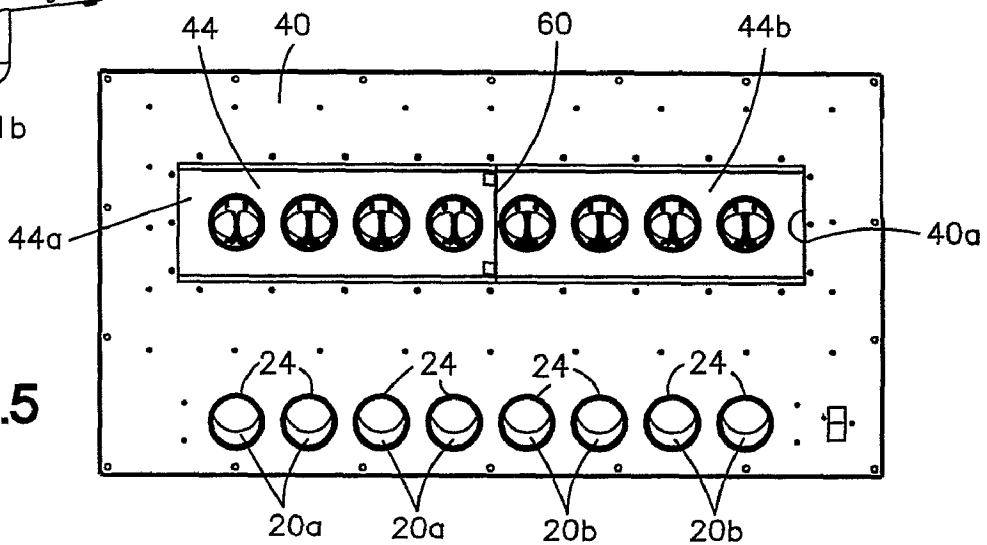
FIG. 5 is an end view of a vestibule plate with heat exchange tubes attached.

FIG. 5 illustrates the construction of the vestibule plate and the mounting of the inlet ends 24*a* of each heat exchange tube, as well as the collector box 44. FIG. 5 also shows the termination of the ends of each heat exchanger tube. The vestibule plate 40 includes circular openings to which the inlet ends 24 of the heat exchanger tubes 20*a*, 20*b* are suitably attached. The vestibule plate 40 also includes a rectangular opening 40*a* (see FIG. 5) over which the collector box 44 is attached. In accordance with the invention, a baffle plate 60 is mounted in the collector box and somewhat separates the outlets of the heat exchanger tubes 20*a* from the outlets of the heat exchanger tube 20*b* and divides the collector box into collector box sections 44*a*, 44*b*. The baffle plate 60 isolates the outlets of the tubes 20*a* from the outlets, of the tubes 20*b* such that the flue gases do not cross-communicate until they enter the induced draft blower 50 through a blower inlet 74 (see FIGS. 9 and 9A).

As seen in FIG. 4, a cover plate 70 is mounted to the vestibule plate 40 and overlies the rectangular opening 40*a* defined in the vestibule plate. The induced draft blower 50 is mounted to the cover plate 70 and concurrently communicates with the collector box sections 44*a*, 44*b* through an opening 74 (shown best in FIGS. 9 and 9*a*). The induced draft blower 50 includes an outlet 50*a* which is suitably connected to a flue pipe or other conduit (not shown) through which the flue gas is discharged to the outside.

In accordance with the invention, the disclosed furnace construction is capable of operating at an 8:1 turn down ratio or more. This is achieved by independently controlling the firing of the burners 14*a*, 14*b*. In conventional constructions, reducing the BTU output of a furnace of this type cannot be achieved by simply reducing the gas flow to the burners. The burners are typically sized and designed to be fired at a limited range of gas flows (usually between a burner's maximum firing rate and no less than 50 percent of the maximum firing rate). If one attempts to fire a burner at substantially less than the gas flow rate it is designed for, flame instability and increased CO emissions may result. In addition, it is usually not possible to maintain operation of the inshot burner over the entire range of gas flows without substantially increasing CO emissions to unacceptable levels due to flame quenching at higher excess air levels which result from reduced gas input (reduced gas flow rates).

By providing separate gas valves 30*a*, 30*b* for the burners 14*a*, 14*b*, it is possible to fire only four of the eight burners at their normal input rate resulting in a 50% reduction in the BTU output of the furnace. This construction has been employed in the past to provide a 2:1 turn down ratio for furnaces.

In accordance with the invention, at least one set of burners (either 14*a*, 14*b*) are designed to operate with a 4:1 (down to 25 percent of nominal input) turn down ratio and at excess air levels greater than 200 percent. For purposes of explanation, it is assumed that the burners 14*b* are to be operated at a 4:1 turn down ratio. This is achieved as follows. As indicated above, the gas valve 30*c*, which is connected to the burners 14*b*, is of a modulating type. As a consequence, the output of the modulating gas valve 30*c* can vary in accordance with the BTU output that is required. In order to enable the burners 14*b* to operate with a wide turn down ratio, the port loading (BTU Hour/square inches of burner port area) for each burner is increased as compared to burners used in applications where they are fired at only one level or at a 2:1 turn down ratio. To increase the port loading of the burners 14*b*, the port area at the discharge end of the burner is reduced. It has been found in the past that reducing the port area of a burner may increase flame instability due to the excess air that travels along the burner body parallel to an axis 58 of the burner 14—see FIG. 6) and cause flame "lift off" at the burner outlet.

Figure 7:
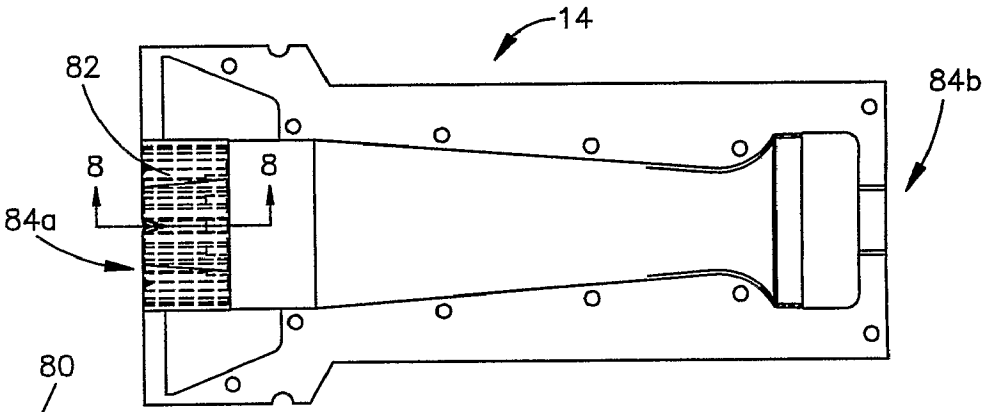
FIG. 7 is a plan view of a burner which may form part of the furnace shown in FIG. 1.
Figure 8:
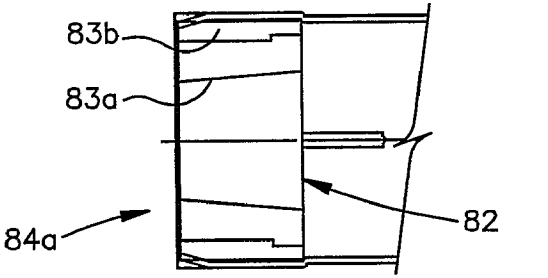
FIG. 8 is a fragmentary sectional view of the burner as seen from the plane indicated by the line 8-8 in FIG. 7.

Referring to FIGS. 7 and 8, the construction of a burner 14 is illustrated, which may be used in the disclosed furnace. The port loading discussed above is, at least in part, determined by the port area of a flame holder 82 forming part of the inshot burner 14. The total port area referred to above includes the cross-sectional area of a primary opening 83*a* forming part of the flame holder 82 and the total cross-sectional areas of flame retention ports 83*b* (shown best in FIG. 8). An output end 84*a* of the burner 14 mounts the flame holder 82, whereas an inlet end 84*b* of the burner generally mounts a gas orifice 85 (see FIGS. 3 and 6) which injects combustible gas into the burner where it is mixed with combustion air and ultimately burned at the outside of the flame holder 82.

Figure 3A:
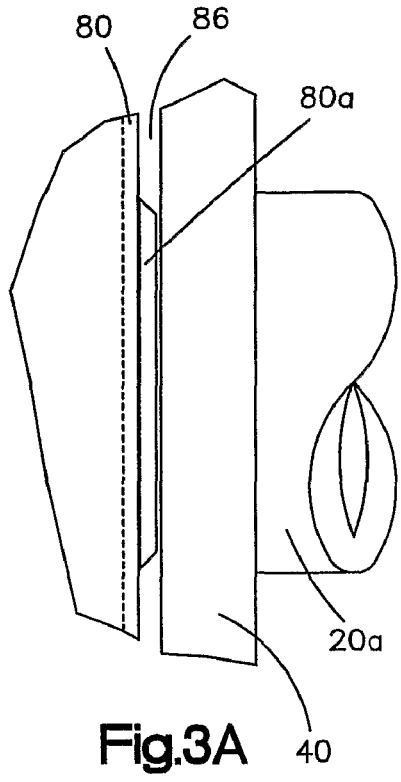
FIG. 3A is an enlarged view of the region encompassed by the circle 3A in FIG. 3.
Figure 6:
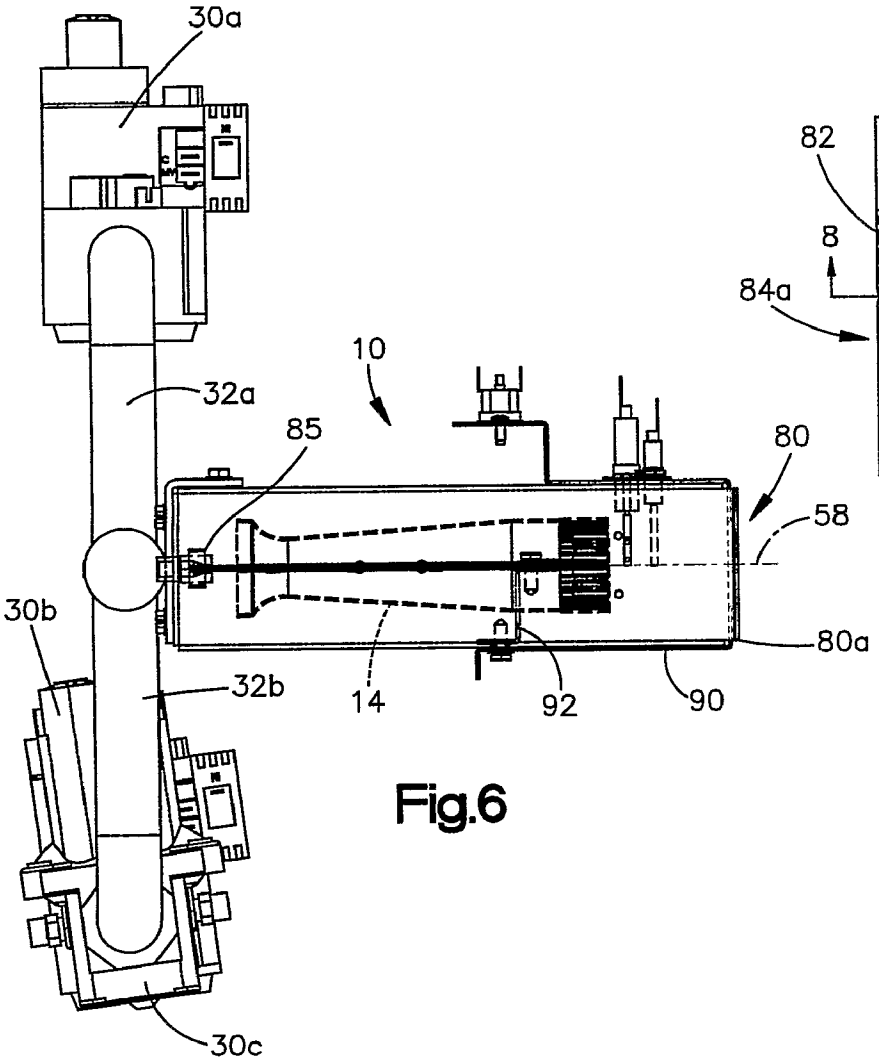
FIG. 6 is a fragmentary view, partially in section, showing a burner assembly and associated gas supply forming part of the present invention.

Referring to FIG. 6, each burner is supported in alignment with its associated heat exchange tube inlet 24. The mounting of the burners 14*a*, 14*b* includes a secondary air or "shoot-through" plate 80 which includes flared out openings 80*a* aligned with an associated burner. In prior art constructions, the shoot through plate forming part of the burner mounting assembly is positioned in abutting engagement with the vestibule plate 40 and in alignment with the heat exchanger tube inlets 24. In accordance with the invention, the shoot through plate 80 of the present invention is spaced from the vestibule plate 40 so that a gap 86 is defined between the shoot through plate 80 and the vestibule plate 40 (shown best in FIG. 3A). This gap 86 provides an excess air flow path that is orthogonal to the axis 58 of each burner 14*a*, 14*b*. It has been found that providing excess air in an orthogonal direction with respect to the axis 58 of the burner helps stabilize the flame and substantially reduces the incidence of flame lift off.

In accordance with a feature of this invention and as best seen in FIG. 6, a bottom flange 90 extends from the secondary air plate 80 back to a burner mounting bracket 92. This flange restricts entry of secondary air to the burner flame prior to the flared openings 80*a* of the secondary air plate 80, which also helps reduces flame lift-off at the burner outlet and provides for flame stability. As a result, the burners 14*b* can operate at a substantially higher port loading as compared to the prior art. By increasing the port loading of the burners 14*b*, along with the provision of an excess air flow path orthogonal to the axis 58 of the burner and limiting secondary air entry to the burner flame prior to the shoot through plate 80, it has been found that the burners 14*b* can operate at a 4:1 turn down ratio (i.e. down to 25 percent of nominal input) and excess air levels of 200 percent or greater while providing stable flames and CO emissions which meet ANSI standards. Thus, by providing the capability of fire burners 14*b* at a 4:1 turndown ratio, in conjunction with the ability to separately fire burners 14*b* from 14*a*, an overall 8:1 turndown ratio is provided (12½% of total capacity).

Figure 9:
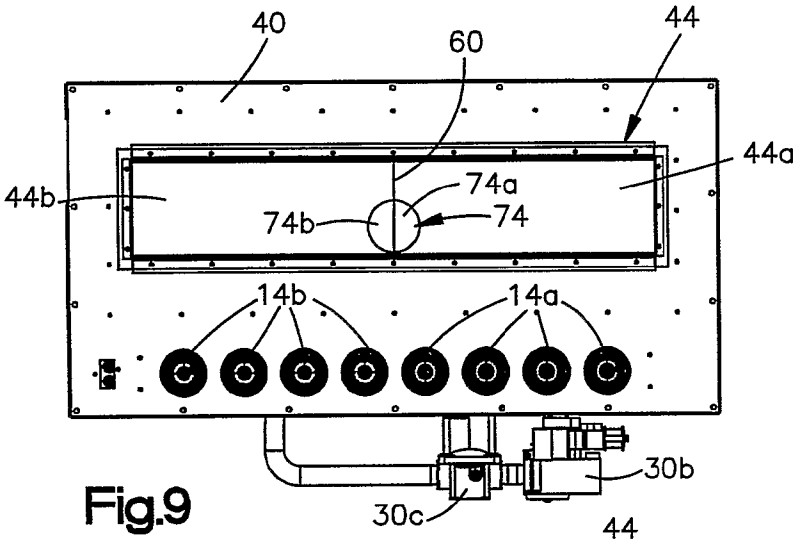
FIG. 9 is a side elevational view of the vestibule plate shown in FIG. 5, but seen from the opposite side.
Figure 9A:
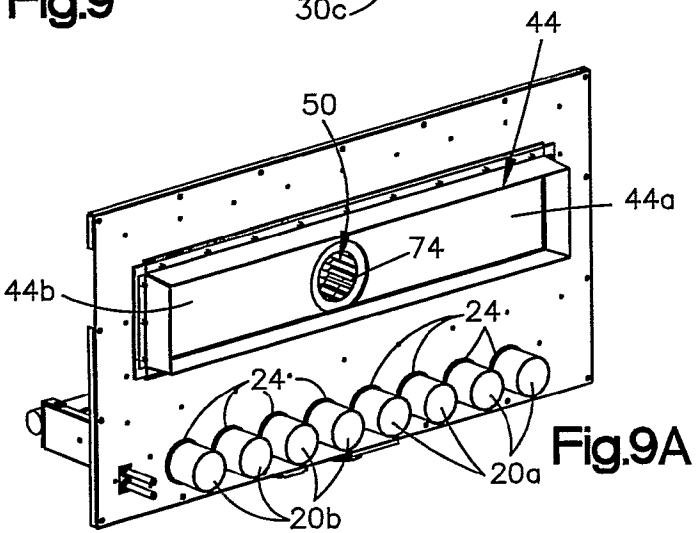
FIG. 9A is a perspective, inside view (similar to the view shown in FIG. 9) of the vestibule plate and associated components; and, FIG. 10 illustrates a tandem orientation of furnaces, constructed in accordance with the preferred embodiment of the invention which are capable of being operated at greater than a 16:1 turndown ratio.

Although separate induced draft blowers could be employed in order to separately draw the flue gases from the heat exchange tubes 20*a*, 20*b*, receptively, in the illustrated embodiment, a singe induced draft blower 50 is utilized in order to reduce cost. Since only a single, multispeed induced draft blower is used, the collector box sections 44*a*, 44*b* must be cross-communicated via the inlet 74 of the induced blower 50. The baffle plate 60 is positioned to divide the inlet 74 and in effect define outlets 74*a*, 74*b* for the collector box sections 44*a*, 44*b*, respectively, thereby controlling the mass flow from each section into the induced draft blower 50. As a result, when the burners 14*a* are not being fired, ambient air is drawn through the associated heat exchange tubes 20*a*. In general, the ambient air is at a much lower temperature and therefore higher density than the flue gas being drawn through the heat exchange tubes 20*b* associated with the burners 14*b*. This temperature imbalance and resulting variance in mass flow rates is compensated for by the positioning of the baffle plate 60. As seen in FIGS. 5, 9 and 9A, the baffle plate 60 is offset so that the volume of the collector box section 14*b* is smaller than that of the collector box section 14*a*. This positioning compensates for the increase in flow resistance that results due to the flow of ambient air through the un-fired heat exchange tubes 20*a*.

Previously, it was possible to achieve a 4:1 ratio by providing both sets of burners 14*a*, 14*b* with a 2:1 turndown ratio and operating only one set of burners. However, this method could not provide continuous modulation over the entire range, but rather had discreet operating points, i.e., 4:1, 2:1 or 1:1, depending on the staging of the burner segments.

The current invention provides for continuous variability in input rate from 4:1 to 1:1 with both sets of burners (14*a*, 14*b*) operating, thereby providing more precise control of outlet air temperature from the furnace. In addition, with the capability to operate one or both sets of burners 14*a*, 14*b* at 4:1, the furnace is capable of continuous variability in input rate from 8:1 to 1:1, further enhancing control and uniformity of air temperature to the space being heated. It should be noted that the turn down ratio can be achieved by operating both sets of burners 14*a*, 14*b* with a 4:1 turn down ratio which would require both sets of burners to have increased port loading and would further require that the burners 14*a* be fed by a modulating gas valve. Larger turn down ratios or enhanced burner operation can be achieved by utilizing a multi speed induced draft blower or an infinitely variable induced draft blower. By using a variable speed or multi speed induced draft blower, the speed of the blower can be reduced in proportion to the reduction of the filing rate of the burners as controlled by a modulating gas valve.

Figure 10:
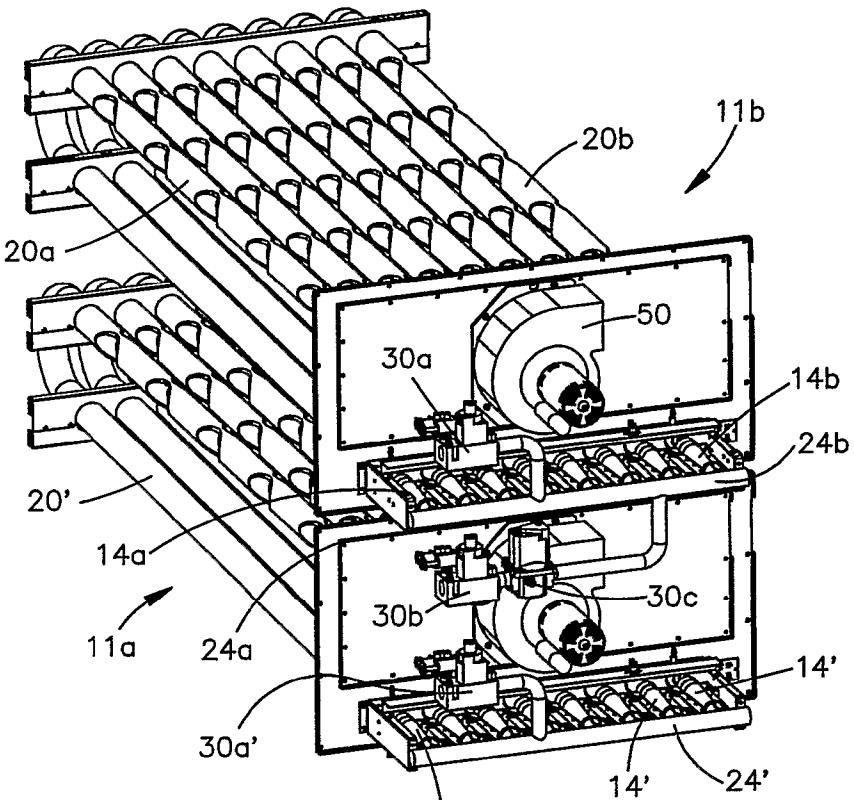

In addition, higher turndown ratios can be achieved by using a plurality of independently controlled furnace modules in a single cabinet or duct section. For example and as illustrated in FIG. 10, two furnace modules 11*a*, 11*b* working in tandem could provide a 16:1 turndown ratio. In the illustrated embodiment, one or both furnace modules 11*a*, 11*b* may be constructed in accordance with the present invention. The invention also contemplates more than two furnace modules working in tandem in order to obtain large turndown ratios. In the embodiment shown in FIG. 10, the module 11*a*, may comprise a standard two-stage duct furnace having similar heat exchange tubes 20. The furnace module 11*a* may include a standard dual stage gas valve 30*a*' that concurrently feeds all burners 14' through a common manifold 24'. With this construction, the furnace module 11*a* is capable of operating at either max output or a reduced output, i.e., 50%), whereas the other module 11*b* comprises a furnace module constructed in accordance with this invention as shown in FIG. 1. With this combination of furnace modules, a substantially continuously variable turndown ration of 32:1 can be achieved.

For a 400,000 BTU/hour furnace of the type illustrated in the Figures, it has been found that burners 14*b*, with a port area of 0.564 square inches, rather than a conventional 0.700 square inches provide satisfactory results. It also is found that a burner 14*b* with this port loading can be reliably operated from a maximum output (50,000 BTU/hour) to ¼ of the maximum output (4:1 turndown ratio) when the gap 86 between the shoot through plate 80 and the vestibule plate 40 is in the range of 3/16" to 5/16".

Although the invention has been described with a certain degree of particularity, it should be understood that those skilled in the art can make various changes to it without departing from the spirit or scope of the invention as hereinafter claimed.

I claim:

1. A gas fired heating apparatus comprising:

a) a plurality of burners, said burners grouped into at least first and second groups;

b) a modulating gas control valve associated with said first group of burners, said modulating control valve connectable to a source of combustible gas and controlling the flow of combustible gas from said source to said first group of burners;

c) a gas control valve associated with said second group of burners, said gas control valve connectable to a source of combustible gas and operative to control the flow of gas from said source to said second group of burners;

d) a heat exchange tube associated with each burner and having an inlet and an outlet, said associated burner firing into an inlet of said associated heat exchange tube;

e) a collector chamber communicating with outlets of said heat exchange tubes;

f) said collector chamber divided into sections by a baffle member located in said collection chamber, one of said sections communicating with the outlets of heat exchange tubes associated with the first group of burners, another section of said collector chamber communicating with the outlets of heat exchange tubes associated with said second group of burners; and, g) an induced draft blower concurrently communicating with said sections of said collector chamber.

2. The apparatus of claim 1 wherein said induced draft blower is a two speed blower.

3. The apparatus of claim 1 wherein said induced draft blower is a variable speed blower.

4. The apparatus of claim 1 wherein said each burner of said first group have a port loading that enables each of said burners of said first group to operate at ¼ of its maximum rated capacity.

5. The apparatus of claim 1 further including a secondary air plate disposed between an output end of said burners of said first group and the inlets of said heat exchange tubes associated with said burners of said first group, said secondary air plate spaced a predetermined distance from said inlets of said associated heat exchange tubes, thereby defining a path of secondary air between said plate and said tube inlets.

6. The apparatus of claim 5 wherein said path of secondary air is substantially orthogonal to an axis of an associated burner.

7. The apparatus of claim 6 further including a secondary air blocking member for restricting the flow of secondary air along said associated burner.

8. The apparatus of claim 7 wherein said baffle plate is offset in said collector box such that said collector box sections are not equal in size.

9. A heating system comprising:

a) at least one gas fired heating apparatus as set forth in claim 1;

b) a second gas fired heating apparatus that includes a plurality of burners that can be operated at, at least one output rate; and, c) a control for coordinating the operation of said first and second heating apparatuses so that at least a 16:1 turndown ratio is achieved.

10. The heating system of claim 9 wherein said second heating apparatus can be operated at a 2:1 turndown ratio and the control coordinates the operation of the first and second heating apparatuses such that a turndown ratio of at least 32:1 is achieved.

11. The heating system of claim 9 wherein said first and second heating apparatuses comprise furnace modules adapted to heat air circulating in a duct.

12. A gas fired heating apparatus comprising:

a) a plurality of burners, said burners grouped into at least first and second groups;

b) a modulating gas control valve associated with said first group of burners, said modulating control valve connectable to a source of combustible gas and controlling the flow of combustible gas from said source to said first group of burners;

c) a gas control valve associated with said second group of burners, said gas control valve connectable to a source of combustible gas and operative to control the flow of gas from said source to said second group of burners;

d) a heat exchange tube associated with each burner and having an inlet and an outlet, said associated burner firing into an inlet of said associated heat exchange tube;

e) a collector chamber communicating with outlets of said heat exchange tubes;

f) a secondary air plate disposed between an output end of said burners of said first group and the inlets of said heat exchange tubes associated with said burners of said first group, said secondary air plate spaced a predetermined distance from said inlets of said associated heat exchange tubes, thereby defining a path of secondary air between said plate and said tube inlets; and g) an induced draft blower communicating with said, collector chamber.

13. The apparatus of claim 12 wherein said collector chamber is divided into sections by a baffle member, one of said sections communicating with the outlets of heat exchange tubes associated with the first group of burners, another section of said collector chamber communicating with the outlets of heat exchange tube associated with said second group of burners.

14. A heating system comprising:

a) at least one gas fired heating apparatus as set forth in claim 12;

b) a second gas fired heating apparatus that includes a plurality of burners that can be operated at, at least one output rate; and, c) a control for coordinating the operation of said first and second heating apparatuses so that at least a 16:1 turndown ratio is achieved.

15. The heating system of claim 14 wherein said second heating apparatus can be operated at a 2:1 turndown ratio and the control coordinates the operation of the first and second heating apparatuses such that a turndown ratio of at least 32:1 is achieved.

16. The heating system of claim 14 wherein said first and second heating apparatuses comprise furnace modules adapted to heat air circulating in a duct.

* * * * *